United States Patent [19]

Mrenna et al.

[11] 3,950,714

[45] Apr. 13, 1976

[54] SELF-ADJUSTING CIRCUIT BREAKER WITH ROTATING TRIP ASSEMBLY

[75] Inventors: Stephen A. Mrenna, Beaver; Alfred E. Maier, Beaver Falls, both of Pa.

[73] Assignee: Westinghouse Electric Corporation, Pittsburgh, Pa.

[22] Filed: Sept. 18, 1974

[21] Appl. No.: 507,165

[52] U.S. Cl. ..... 335/35; 335/45

[51] Int. Cl.[2] ..... H01H 75/12

[58] Field of Search ..... 335/35, 37, 38, 42, 44, 335/45, 170, 171, 174, 176; 337/70, 71

[56] References Cited

UNITED STATES PATENTS

| | | | |
|---|---|---|---|
| 2,797,278 | 6/1957 | Gelzheiser et al. | 335/174 X |
| 3,278,707 | 10/1966 | Klein | 335/35 X |
| 3,278,708 | 10/1966 | Casey et al. | 335/35 X |

*Primary Examiner*—G. Harris

*Attorney, Agent, or Firm*—R. E. Converse, Jr.

[57] ABSTRACT

A molded case circuit breaker is described including a U-shaped thermal and magnetic trip assembly pivotally supported by an insulating housing. A compression spring biases the trip assembly against a releasable cradle which is engaged by a latch. The biasing action of the spring against the pivoting trip assembly maintains a constant latch bite despite warping or other mechanical distortion of the insulating housing.

11 Claims, 4 Drawing Figures

SELF-ADJUSTING CIRCUIT BREAKER WITH ROTATING TRIP ASSEMBLY

BACKGROUND OF THE INVENTION

1. Field of the Invention

This invention relates in general to molded case circuit breakers and more particularly to molded case circuit breakers employing thermal and magnetic trip assemblies.

2. Description of the Prior Art

Small molded case automatic circuit breakers are widely used in commercial, industrial and residential installations to provide protection against over-current conditions. In order to perform reliably these circuit breakers must be accurately calibrated to interrupt the flow of current at the desired overload level. They must remain in calibration over long periods of time and over wide extremes of temperatures occurring in the operating environment. Since the calibration of these circuit breakers is dependent on physical dimensions between the various components it is important that these dimensions remain constant over the expected extremes of temperature. One method of insuring dimensional stability over temperature extremes is to mount critical components of the trip assembly upon a metal frame enclosed within the molded insulating case. This method is employed in the circuit breaker described in U.S. Pat. Nos. 3,088,008 and 3,110,786 issued to Francis L. Gelzheiser and assigned to the assignee of the present invention. If these critical components can be supported directly by the molded case and means can be provided to adequately adjust for mechanical distortion of the case, the metal frame can be eliminated, thereby reducing the cost of the circuit breaker.

Elimination of the frame is possible if the insulating case is molded of material having a low thermal coefficient of expansion, such as phenolic. However, phenolic exhibits undesirable characteristics under arcing conditions produced by separating contacts, thereby requiring metallic arc chutes to shield the phenolic from the arc.

A circuit breaker with an insulating case molded from urea would not require the use of arc chutes, for urea does not exhibit the undesirable characteristics of phenolic material under arcing conditions. In fact, urea will release an arc-extinguishing gas when subjected to the high temperatures produced by an arc. However, urea is not as mechanically stable under varying temperature conditions as is phenolic, and is therefore unsuitable for those applications requiring a circuit breaker with accurate calibration. It would be desirable to produce a molded case circuit breaker employing urea or other low-cost material as the case material wherein the calibration of the breaker would not be affected by thermal expansion or other physical distortion of the case.

SUMMARY OF THE INVENTION

In accordance with a preferred embodiment of the present invention there is provided a circuit breaker comprising an insulated housing, and a circuit breaker mechanism supported within the housing including separable contacts and an opening cradle releasable to affect automatic separation of the contacts. The cradle includes a reference surface and a latchable member. The circuit breaker also comprises a latch engaging the latchable member and operable to initiate release of the cradle by disengagement of the latchable member. A trip assembly is provided which is movably supported within the housing and is operable to disengage the latch from the latchable member upon over-current conditions. The trip assembly comprises a positioning member cooperable with the reference surface of the releasable cradle. A bias spring is provided which acts upon the trip assembly to bias the positioning member into cooperation with the reference surface, the bias spring and positioning member maintaining a constant degree of engagement between the latch and the latchable member. The calibration of the circuit breaker is not affected by warpage or other mechanical distortion of the insulating housing.

BRIEF DESCRIPTION OF THE DRAWING

The invention may be more readily understood when considered in view of the following detailed description of exemplary embodiments thereof, taken with the accompanying drawings in which.

DESCRIPTION OF THE PREFERRED EMBODIMENT

Figure 1:
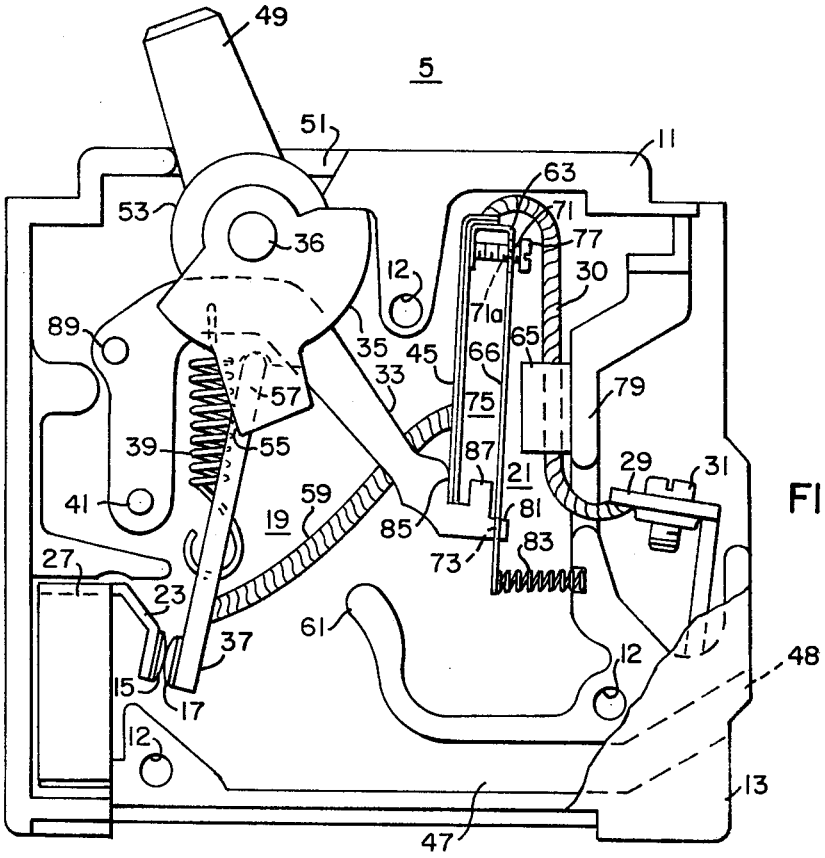
FIG. 1 is a vertical elevational view of a circuit breaker with contacts closed, with the cover broken away, and partly in section embodying the principles of the invention.

Throughout the drawings like reference characters refer to like members.

Referring to FIG. 1, a circuit breaker 5 comprises an open-sided case or housing 11 of molded insulating material and a cover plate 13 also of molded insulating material. The cover plate 13 is shown broken away to more clearly illustrate the mechanism, which includes stationary contact means 15, movable contact means 17, an operating mechanism 19, and a trip assembly 21.

The stationary contact 15 is rigidly secured to the inner end of a conducting strip 23, the outer end of which is provided with a terminal connecting means, such as a plug-in member 27 for connecting the breaker in an electric circuit. At the opposite end of the housing 11 there is a conducting plate 29 connected by means of a flexible conductor 30 to the trip assembly 21. The conducting plate 29 is provided with a terminal connecting means, such as a screw 31, for connecting the breaker in an electric circuit.

The movable contact 17 is rigidly secured on the free end of a U-shaped switch arm 37 having its legs 57 supported in recesses in the legs 55 of a U-shaped operating lever 35 of molded insulating material. The operating lever 35 is pivotally mounted by means of trunnions 36 molded integral therewith. The trunnions 36 are supported in suitable companion openings (not shown) in the housing 11 and in the cover 13. An operating spring 39 is connected under tension between the bight of the switch arm 37 and a releasable cradle 33. The cradle 33 is pivoted on a pin 41 supported in openings in the housing 11 and the cover plate 13.

The operating lever 35 is provided with an operating handle 49 molded integral therewith and extending out through an opening 51 in the housing 11. The operating lever 35 is also provided with an arcuate member 53 molded integral therewith. The arcuate member 53 cooperates with the housing 11 to substantially close the opening 51 in all positions of the handle 49. The switch arm 37 is electrically connected by means of a flexible conductor 59 to one end of a bimetal element 45 forming part of the trip assembly 21, to be more fully described later.

With the circuit breaker in a closed circuit position, as shown in FIG. 1, current flows from the plug-in member 27 through the conducting strip 23, the stationary contacts 15, the movable contact 17, the switch arm 37, the flexible conductor 59, the bimetal element 45, and the flexible conductor 30 to the terminal comprising the conducting plate 29 and the screw 31.

The housing 11 and cover plate 13 are joined by three bolts passing through holes 12 in the housing 11 and cover 13 and threaded into nuts (not shown) seated in recesses on the under exterior surface of the housing 11. The various components and members of the operating mechanism and trip assembly are thus rigidly secured in their respective recesses within the interior of the housing 11 and cover 13.

The switch arm 37 is operated to manually open and close the contacts 15 and 17 by manipulation of the handle 49. Movement of the handle 49 in a clockwise direction from the position shown in FIG. 1 carries the upper pivoted ends of the legs 57 of the switch arm 37 across to the left of the line of action of the operating spring 39, which then biases the switch arm 37 to the open position and causes movement of the switch arm 37 to the open position with a snap action.

The contacts are manually closed by reverse movement of the handle 49. Counterclockwise movement of the handle 49 from the open position to the closed position, shown in FIG. 1, moves the upper ends of the legs 57 of the switch arm 37 across to the right of the line of action of the spring 39 which thereupon acts to close the contacts 15 and 17 with a snap action.

Arcs drawn between the contacts 15 and 17 during opening or closing operations generate hot gases which are vented through a passage 47 extending along the base of the housing 11 and out through an opening 48 in the end of the housing opposite the contacts. Arc extinguishers, such as a stack of spaced slotted plates of magnetic material, are not required for the present invention if the insulating housing 11 is fabricated of urea, which produces arc-extinguishing gas when subjected to arcing conditions.

Figure 2:
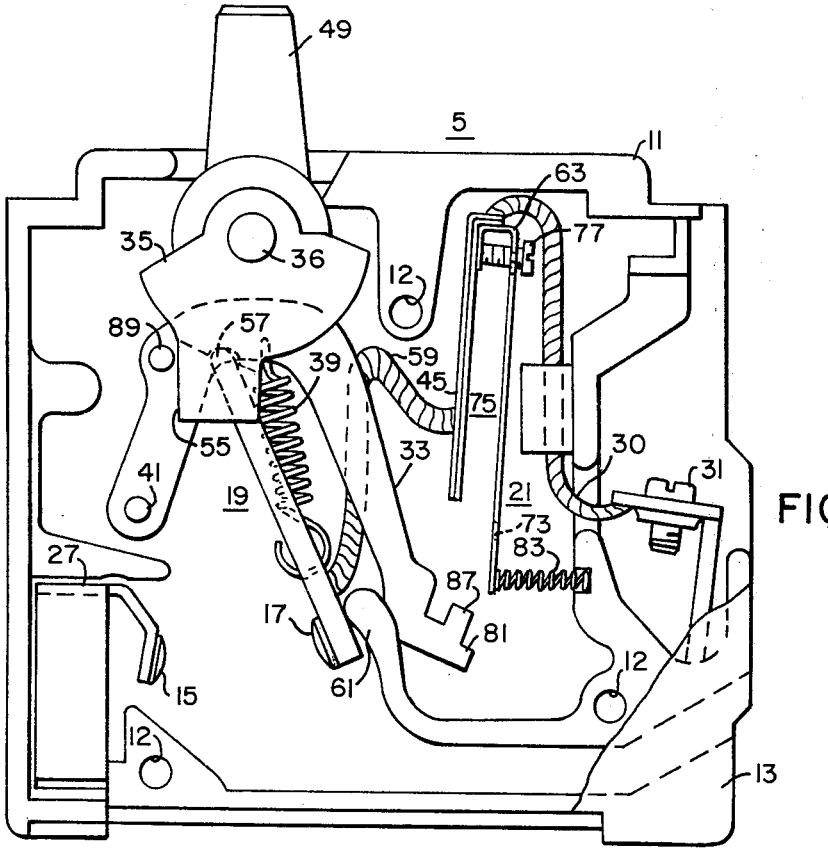
FIG. 2 is similar to FIG. 1 with the circuit breaker shown in a tripped open condition.

The circuit breaker is adapted to be tripped open instantaneously in response to overload currents above a predetermined value, or in response to short circuit currents, and after a time delay on lesser overload currents, by means of the trip assembly 21. Operation of the trip assembly 21 releases the cradle 33 whereupon the operating spring 39 pivots the cradle 33 clockwise about the pin 41 carrying the line of action of the spring 39 across to the right of the pivot of the switch arm 37. Thereafter the spring 39 acts to move the switch arm to open position with a snap action. A clockwise movement of the cradle 33 is arrested by the engagement with a projection 61 of the housing 11. The position of the various members of the circuit breaker following a tripping operation is shown more clearly in FIG. 2.

Figure 3:
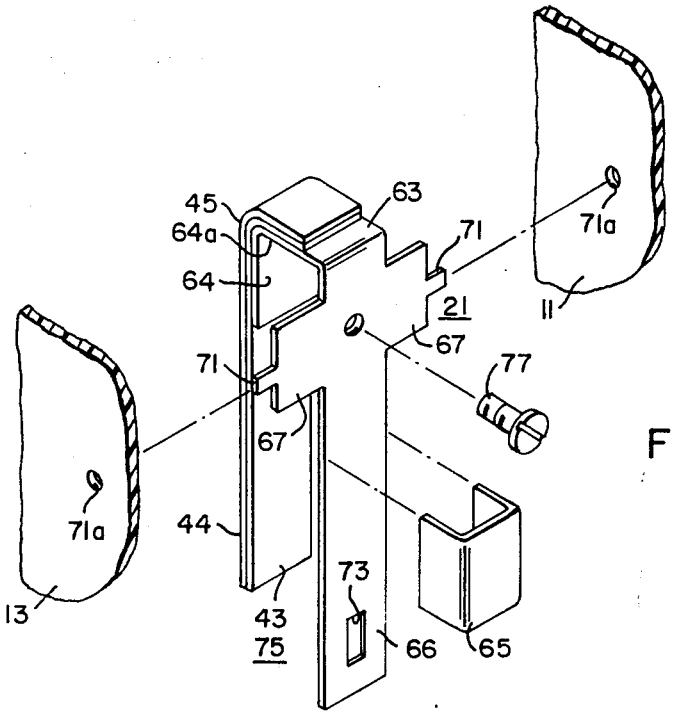
FIG. 3 is a perspective view of the trip assembly.

The trip assembly 21, shown more clearly in FIG. 3, comprises an L-shaped bimetal element 45 and an electromagnet including an armature 63 and a U-shaped magnetic yoke 65. The bimetal element 45 is composed of a material 43 having a high thermal coefficient of expansion bonded to a material 44 having a low thermal coefficient of expansion. The bimetal element 45 is formed into an L-shape. The upper end of the armature 63 is bent into a hook-shaped projection including a lip 64 and a base 64*a*. The outer surface of the lip 64 and a base 64*a* are joined, preferably by welding, to the two surfaces of the high expansion material 43 of the bimetal element 45 to form a substantially U-shaped pivot assembly 75.

At the upper end of the armature 63 are laterally extending shoulders 67 with pivot ears 71 integral therewith. A latch aperture 73 is formed in the lower end of the main body 66 of the armature 63. A calibrating screw 77 is threaded through an aperture in the armature 63, the tail of the screw 77 bearing against the inner surface of the lip 64. Adjustment of the screw 77 exerts varying amounts of force against the inner surface of the lip 64, thereby adjusting the distance separating the lower ends of the bimetal element 45 and the armature 63.

The magnetic yoke 65 is mounted by any suitable means such as riveting or bonding to a projecting rib 79 of the housing 11. The flexible conductor 30 extends through the interior of the U-shaped magnetic yoke 65 between it and the main body 66 of the armature 63.

As shown in FIG. 1, the latch aperture 73 of the magnetic armature 63 engages a latch tab 81. The pivot assembly 75 pivots upon the pivot ears 71 in holes 71*a* of the housing 11 and cover plate 13 and is biased by compression spring 83 against either a reference surface 85 or a latch stop 87 of the cradle 33, depending upon the separation of the lower ends of the bimetal element 45 and the armature 63.

Since the lower end of the bimetal element 45 is in contact with the reference surface 85 of the cradle 33 due to the biasing action of the spring 83, the distance separating the lower end of the bimetal 45 and the armature 63 determines the amount of latch bite, that is, the degree of engagement between the latch tab 81 and the latch aperture 73. By turning the calibrating screw 77, a greater or lesser force is brought to bear on the lip 64, depending on the direction the screw 77 is turned. This causes flexure of the lip 64 and attached bimetal element 45, thereby changing the separation distance between the lower end of the bimetal element 45 and the armature 63 and, consequently, the latch bite. The latch bite is thus adjusted by means of the calibratiing screw 77. A maximum permissible latch bite is provided by the latch stop 87 which limits the degree of engagement between the latch tab 81 and the latch aperture 73.

Upon the occurrence of an overload current above rated current but below a predetermined value of, for instance, 1000 percent of rated current, the bimetal element 45 is heated by the current flow therethrough and attempts to deflect to the left against the reference surface 85. This causes the pivot assembly 75 to pivot counterclockwise in the holes 71*a* causing the latch aperture 73 to release the latch tab 81 of the cradle 33. The operating mechanism then functions in the manner previously described to automatically open the breaker contacts.

When a heavy overload current, for example 1000 percent or more of rated current, or a short circuit current occurs, the current flowing through the flexible conductor 30 generates a magnetic field sufficient to cause the magnetic yoke 65 to instantaneously attract the armature 63, thus causing the release of the cradle 33 and effecting instantaneous opening of the breaker contacts.

Before the contacts can be closed following an automatic opening operation, it is necessary to reset and relatch the operating mechanism. This is accomplished by moving the handle 49 clockwise to the full open position during which movement the legs 55 of the operating lever 35 engage a pin 89 in the cradle 33 and move the cradle 33 counterclockwise about its pivot 41. Near the end of its counterclockwise movement, the latch tab 81 wipes by the lower end of the armature 63 pivoting the pivot assembly 75 against the biasing action of the compression spring 83. The latch tab then resumes its normal latching position within the latch aperture 73. The switch arm 37 is then moved to close the contacts in the previously described manner by movement of the handle 49 counterclockwise to the closed position.

In the event the housing 11 and cover plate 13 are stressed, for example by improper mounting techniques or change in ambient temperature conditions, the relative dimensions and separation distances of the various members of the mechanism and housing will change. In previous breakers this has sometimes meant that the amount of latch bite would change, thereby upsetting the calibration of the circuit breaker. In the present invention however, a change in the dimensions of the housing 11 and cover plate 13 is prevented from affecting the amount of latch bite or the calibration of the breaker. If the housing 11 expands, the distance between the points of support for the pivot assembly 75 and the cradle 33 increases. However, the biasing action of the spring 83 causes the pivot assembly 75 to rotate. If the adjustment of the calibration screw 77 is such that the lower end of the bimetal element 45 was in contact with the reference surface 85 prior to expansion of the housing, the biasing action of the spring 83 and rotation of the pivot assembly 75 will insure that the lower end of the bimetal element 45 is maintained in contact with the reference surface 85. Since the distance separating the lower ends of the bimetal 45 and the armature 63 remains substantially constant, the latch bite will also remain substantially constant even though the dimensions of the housing 11 have varied. If the adjustment of the calibration screw 77 is such that the lower end of the bimetal assembly 45 was not in contact with reference surface 85 but the armature 63 was in contact with the latch stop 87 then the biasing action of the spring 83 will insure that the armature 63 remains in contact with the latch stop 87, again maintaining the same degree of latch bite although the dimensions of the housing 11 are changing.

Figure 4:
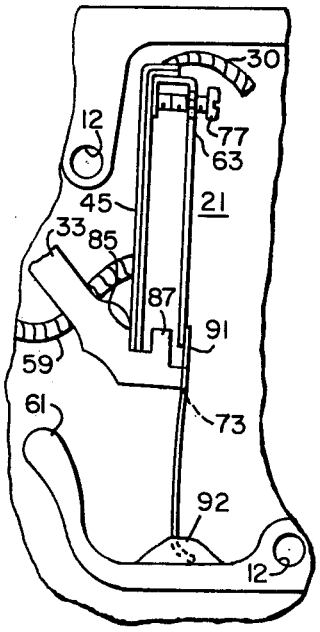
FIG. 4 is a detailed vertical elevational view of the trip assembly and latching means of an alternative embodiment.

FIG. 4 shows an alternate embodiment of the principles of the invention. Here a resilient latch spring 91 is attached by bonding with epoxy or other suitable fastening means as at 92 to the projection 61 of the housing 11. The inherent mechanical stiffness of the resilient latch spring 91 biases the latch spring 91 against the lower end of the armature 63 or the latch stop 87, depending on the adjustment of the calibration screw 77 which determines the separation of the lower ends of the armature 63 and the bimetal element 45.

In this alternative embodiment it can be seen that it is possible to adjust the circuit breaker so that the armature has free travel before taking up the latch load. Since the armature 63 is not connected to the latch it is free to oscillate, producing a series of impacts against the latch spring 91 allowing the mechanism to magnetically trip at lower currents.

If field calibration of the breaker is not required the calibration screw 77 may be omitted. When the screw 77 is omitted, the pivot assembly 75 is bent at the factory to the degree required to establish the desired separation between the lower ends of the bimetal element 45 and the armature 63. In addition, the latch stop 87 may be omitted if it is not required to set a maximum amount of latch bite. The latch bite would then be determined solely by the separation between the lower ends of the bimetal element 45 and armature 63 when the lower end of the bimetal element 45 is biased by either a latch spring 91 or a compression spring 83 into contact with the reference surface 85 of the operating cradle 33. Thus, it can be seen that the lower end of the bimetal element 45 functions as a positioning surface which cooperates with the reference surface 85 to maintain a constant latch bite under shrinkage or expansion of the housing 11 and cover plate 13.

Although the circuit breaker in the described embodiment includes both thermal and magnetic tripping mechanisms the present invention may be utilized with only one of the included tripping mechanisms.

The principles of the invention could be employed in a molded-case circuit breaker in which the various components are mounted upon a frame of metal or other material supported within the housing. However, such a frame is not required with the present invention and substantial cost savings can be realized with the elimination of the frame.

The insulating housing 11 and cover plates 12 may be fabricated of urea or other low-cost material having favorable electrical characteristics, such as the production of arc-extinguishing products during arcing conditions, while eliminating the need of a costly metal frame provided in previous circuit breakers to support the various mechanism members. The latch engagement is held constant by the self-adjusting feature provided by the invention. Thus, it can be seen that there is provided a molded case circuit breaker exhibiting better performance by maintaining calibration over a wide range of operating environments which can be constructed at a lower cost.

While the invention has been disclosed with reference to the described embodiment it is to be understood that various changes in the structural details and arrangement of parts thereof may be made without departing from some of the essential features of the invention.

We claim:

1. A circuit breaker comprising:

a. an insulating housing;

b. a circuit breaker mechanism supported within said housing, said mechanism comprising separable contacts;

c. operating means releasable to effect automatic separation of said contacts, said operating means comprising a latchable member;

d. latch means engaging said latchable member and operable to initiate release of said operating means upon disengagement of said latchable member;

e. trip means operable to disengage said latch means from said latchable member upon overcurrent conditions;

f. bias means biasing said latch means into engagement with said latchable member; and g. adjustable positioning means determining the degree of engagement between said latch means and said latchable member;

h. said bias means and said adjustable positioning means cooperating to maintain a constant degree of engagement between said latch means and said latchable member.

2. A circuit breaker as defined in claim 1 wherein said operating means comprises a reference surface and said bias means biases said positioning means into cooperation with said reference surface.

3. A circuit breaker as defined in claim 2 wherein said trip means is movably supported within said insulating housing and said adjustable positioning means comprises one surface of said trip means.

4. A circuit breaker as defined in claim 3 wherein said trip means is pivotally supported by said insulating housing.

5. A circuit breaker as defined in claim 4 wherein said trip means comprises a U-shaped pivot assembly having first and second legs.

6. A circuit breaker as defined in claim 5 wherein said U-shaped pivot assembly comprises a bimetal member.

7. A circuit breaker as defined in claim 5 wherein said bias means comprises a spring connecting said pivot assembly and said insulating housing.

8. A circuit breaker as defined in claim 5 wherein said latch means and said bias means comprise an apertured resilient leaf spring attached to said insulating housing.

9. A circuit breaker as defined in claim 5 wherein said operating means further comprises a latch stop defining a maximum degree of engagement between said latchable member and said latch means.

10. A circuit interrupter as defined in claim 5 wherein said operating means comprises a releasable cradle, said cradle comprising a reference surface and a latch stop, said adjustable positiong means comprises said first leg of said U-shaped pivot assembly cooperating with said reference surface and said latch stop, and said adjustable positioning means also comprises a screw threaded through said second leg having a tail bearing against said first leg.

11. A circuit interrupter as defined in claim 5 wherein said operating means, said trip means, and said latch means are all supported by said insulating housing.

* * * * *